US005922083A

United States Patent [19]

Biscarini et al.

[11] Patent Number: 5,922,083

[45] **Date of Patent: *Jul. 13, 1999**

[54] DETERGENT COMPOSITION COMPRISING A MUTANT AMYLASE ENZYME AND OXYGEN BLEACHING AGENT

[75] Inventors: Lamberto Biscarini, Bologna; Marina Trani, Rome, both of Italy

[73] Assignee: Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/930,302

[22] PCT Filed: Mar. 12, 1996

[86] PCT No.: PCT/US96/03340

§ 371 Date: Oct. 3, 1997

§ 102(e) Date: Oct. 3, 1997

[87] PCT Pub. No.: WO96/31583

PCT Pub. Date: Oct. 10, 1996

[30] Foreign Application Priority Data

Apr. 3, 1995 [EP] European Pat. Off. ..... 95870031

[51] Int. Cl.[6] ..... C11D 3/386; C11D 3/395; D06B 1/00

[52] U.S. Cl. ..... 8/137; 510/283; 510/284; 510/305; 510/311; 510/320; 510/357; 510/490; 510/372; 510/374; 510/375; 510/396

[58] Field of Search ..... 510/283, 284, 510/305, 309, 311, 320, 357, 372, 374, 375, 392, 490; 8/137

[56] References Cited

U.S. PATENT DOCUMENTS

| | | | |
|---|---|---|---|
| 5,468,884 | 11/1995 | Eckhardt | 549/437 |
| 5,501,820 | 3/1996 | Van den Bergh et al. | 252/549 |
| 5,536,436 | 7/1996 | Pramod et al. | 510/321 |
| 5,578,136 | 11/1996 | Taylor et al. | 139/25.2 |
| 5,595,967 | 1/1997 | Miracle et al. | 510/372 |
| 5,629,278 | 5/1997 | Baeck et al. | 510/236 |
| 5,654,421 | 8/1997 | Taylor et al. | 540/531 |
| 5,670,466 | 9/1997 | Sivik et al. | 510/102 |
| 5,691,298 | 11/1997 | Gosseink et al. | 510/475 |
| 5,721,202 | 2/1998 | Waite et al. | 510/102 |

FOREIGN PATENT DOCUMENTS

| | | |
|---|---|---|
| WO 94/02597 | 2/1994 | WIPO . |
| WO 94/18314 | 8/1994 | WIPO . |

*Primary Examiner*—Kery Fries
*Attorney, Agent, or Firm*—C. Brant Cook; Kim W. Zerby; Jacobus C. Rasser

[57] ABSTRACT

Soaking compositions are disclosed which comprise a bleach, a builder; an anionic surfactant, a proteolytic enzyme; and a stability enhanced amylase enzyme. A process of soaking fabrics is also disclosed, wherein said fabrics are immersed in a soaking liquor comprising water and an effective amount of the composition above.

13 Claims, No Drawings

DETERGENT COMPOSITION COMPRISING A MUTANT AMYLASE ENZYME AND OXYGEN BLEACHING AGENT

TECHNICAL FIELD

The present invention relates to the cleaning of fabrics in soaking conditions, i.e. in conditions where the fabrics are left to soak in a soaking liquor comprising water and detergent ingredients, either as a first step before a typical washing operation, or as a single step.

BACKGROUND

Fabric soaking operations have been described in the art. In such soaking operations, fabrics are left in contact with a soaking liquor for a prolonged period of time ranging from a few hours to overnight. This laundering process has the advantage that it maximizes the contact time between the fabrics and the key active ingredients of the soaking liquor. It also has the advantage that it reduces or eliminates the need for a typical laundering operation involving the need for mechanical agitation, or that it improves the efficiency of the subsequent typical laundering operation.

Such soaking operations are typically efficient to remove tough stains such as blood and food stains, which comprise a blend of proteic substances as well as starch. Thus it is desirable that soaking compositions should comprise a protease as well as an amylase. However with such a soaking composition, amylases themselves are subject to proteolytic attack, as the soaking composition is dissolved to form a soaking liquor. This is a particularly acute problem in the context of soaking, where the contact time between the ingredients in general, the amylase and the protease in particular, is generally enormously longer than in typical laundering operation. Thus it is one object of the present composition to provide soaking compositions which comprise an amylase and a protease, and where the amylase will resist proteolytic attack for a significant period of time.

Another requirement of soaking compositions is that they should comprise an oxygen bleach, preferably a high amount of such a bleach. Indeed, an oxygen bleach finds suitable conditions for efficacy in a soaking operation where, contact time between the actives of the compositions and the soiled fabrics is maximized. However, the presence of bleach is also detrimental to the stability of the enzymes throughout the period of the soaking operation. Indeed bleaches, especially at high level tend to denature the quaternary stucture of the enzymes, exposing amylase to an even more aggressive proteolytic attack.

Still another requirement of soaking compositions is that they should comprise significant amounts of builders. Indeed the presence of builders is necessary to effectively control water hardness. Builders are even more necessary in soaking conditions where contact time between fabrics and wash solution is longer, as compared to normal washes, thus hardness must be controlled for a much longer time. To comply with the peculiarities of the soaking process, soaking compositions must therefore contain high levels of builders. However, the presence of high levels of builders is also detrimental to the action of enzymes. Indeed, these builders tend to bind all the calcium present in the soak solution, amongst other things, while some calcium is needed to ensure appropriate enzyme activity.

Finally, another requirement of soaking compositions is that they should comprise significant amounts of an anionic surfactant. A preferred anionic surfactant class, for cost and performance reasons is alkylbenzene sulphonate, particularly linear ones. Certain anionic surfactants, linear alkylbenzene sulphonates (LAS) in particular, however appear to be detrimental to enzyme stability.

It is thus an object of the present invention to provide a soaking composition suitable for a soaking operation, which comprises an amylase in combination with a protease, a bleaching system, a high amount of a builder, and an anionic surfactant, preferably LAS, wherein said amylase remains active for a long period of time, consitent with the characteristics of a soaking operation.

SUMMARY OF THE INVENTION

In one embodiment, the present invention encompasses compositions comprising:

an oxygen bleach;

from 5% to 50% by weight of the total composition of a builder;

from 0.5% to 20% by weight of the total composition of an anionic surfactant, preferably linear alIkyl benzene sulphonates, a proteolytic enzyme; and a stability enhanced amylase enzyme, said stability enhancement being relative to the parent/non-mutant form of said amylase enzyme.

In another embodiment, the present invention encompasses a process of soaking fabrics, wherein said fabrics are immersed in a soaking liquor comprising water and an effective amount of the composition above/

DETAILED DESCRIPTION OF THE INVENTION

The present invention encompasses a composition and a process of soaking fabrics. The composition, hereinafter referred to as the soaking composition is used in the soaking process.

A—The Composition

In its first embodiment, the present invention encompasses a composition which comprises a bleach, a builder; an anionic surfactant, a proteolytic enzyme; and an amylolytic enzyme.

1—The Oxygen Bleach

As a first essential ingredient, the compositions herein comprise an oxygen bleach. Suitable oxygen bleaches in the composition may come from a variety of sources such as hydrogen peroxide or any of the addition compounds of hydrogen peroxide, or organic peroxyacid, or mixtures thereof. By addition compounds of hydrogen peroxide it is meant compounds which are formed by the addition of hydrogen peroxide to a second chemical compound, which may be for example an inorganic salt, urea or organic carboxylate, to provide the addition compound. Examples of the addition compounds of hydrogen peroxide include inorganic perhydrate salts, the compounds hydrogen peroxide forms with organic carboxylates, urea, and compounds in which hydrogen peroxide is clathrated.

Examples of inorganic perhydrate salts include perborate, percarbonate, perphosphate and persilicate salts. The inorganic perhydrate salts are normally the alkali metal salts. The alkali metal salt of percarbonate, perborate or mixtures thereof, are the preferred inorganic perhydrate salts for use herein. Preferred alkali metal salt of percarbonate is sodium percarbonate.

Other suitable oxygen bleaches include persulphates, particularly potassium persulphate $K_2S_2O_8$ and sodium persulphate $Na_2S_2O_8$.

Soaking compositions in the present invention may comprise from 1% to 60% by weight of composition of a hydrogen peroxyde source, preferably from 2% to 40% and more preferably from 15% to 40%.

2—The Builder

As a second essential ingredient, the compositions herein comprise a builder, or mixtures thereof, in amounts of from 5% to 50% by weight of the total composition, preferably 10% to 40%, most preferably 15% to 30%. Suitable builders for use herein include inorganic as well as organic builders.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called weak builders (as compared with phosphates) such as citrate, or in the so-called underbuilt situation that may occur with zeolite or layered silicate builders.

Examples of silicate builders are the alkali metal silicates, particularly those having a $SiO_2$:$Na_2O$ ratio in the range 1:6:1 to 3:2:1 and layered silicates, such as the layered sodium silicates described in the U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the NaSKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001, published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z[(zAlO2)_y]xH_2O$$

wherein z and y are integers of at least 6, the molar ratio of z to y is in the range from 1.0 to about 0.5, and x is an integer from about 15 to about 264.

Useful aluminosilicates can be crystalline or amorphous in structure and can be naturally-occurring aluminosilicates or synthetically derived. A mtehod for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P(B), Zeolite MAP and Zeolite X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboyxlate compounds. As used herein, polycarboxylate refers to compounds having a plurality of carboxylate groups, preferably at least 3 carboxylates. Polycarboxlate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as dislcosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboyxiates also include cyclic compounds, particularly alicyclic compounds, such as those described in U.S. Pat. Nos. 3,923,679; 3,835,163; 4,120,874 and 4,102,903.

Other useful detergency builders include the ether hydroxypolycarboxylates, such as 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Other useful polycarboxylate buiders for use herein include builders according to formula I

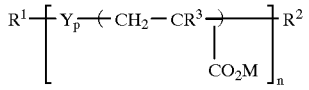

wherein Y is a comonomer or comonomer mixture; $R^1$ and $R^2$ are bleach- and alkali-stable polymer-end groups; $R^3$ is H, OH or $C_{1-4}$ alkyl; M is H, alkali metal, alkaline earth metal, ammonium or substituted ammonium; p is from 0 to 2; and n is at least 10, or mixtures thereof.

Preferred polymers for use herein fall into two categories. The first category longs to the class of copolymeric polymers which are formed from an saturated polycarboxylic acid such as maleic acid, citraconic acid, itaconic acid, mesaconic acid and salts thereof as first monomer, and an unsaturated monocarboxylic acid such as acrylic acid or an alpha —$C_{1-4}$ alkyl acrylic acid as second monomer. Referring to formula I hereinabove, the polymers belonging said first class are those where p is not 0 and Y is selected from the acids listed hereinabove. Preferred polymers of this class are those according to formula I hereinabove, where Y is maleic acid. Also, in a preferred embodiment, $R^3$ and M are H, and n is such that the polymers have a molecular weight of from 1000 to 400 000 atomic mass units.

The second category of preferred polymers for use herein belongs to the class of polymers in which, referring to formula I hereinabove, p is 0 and $R^3$ is H or $C_{1-4}$ alkyl. In a preferred embodiment n is such that the polymers have a molecular weight of from 1000 to 400 000 atomic mass units. In a highly preferred embodiment, $R^3$ and M are H.

The alkali-stable polymer end groups $R^1$ and $R^2$ in formula I hereinabove suitably include alkyl groups, oxyalkyl groups and alkyl carboxylic acid groups and salts and esters thereof.

In the above, n, the degree of polymerization of the polymer can be determined from the weight average polymer molecular weight by dividing the latter by the average monomer molecular weight. Thus, for a maleic-acrylic copolymer having a weight average molecular weight of 15,500 and comprising 30 mole % of maleic acid derived units, n is 182 (i.e. 15,500/(116×0.3+72×0.7)).

Temperature-controlled columns at 40° C. against sodium polystyrene sulphonate polymer standards, available from Polymer Laboratories Ltd., Shropshire, UK, the polymer standards being 0.15M sodium dihydrogen phosphate and 0.02M tetramethyl ammonium hydroxide at pH 7.0 in 80/20 water/acetonitrile.

Of all the above, highly preferred polymers for use herein are those of the first category in which n averages from 100 to 800, preferably from 120 to 400.

Citrate builders, e.g. citric acid and soluble salts thereof (particularly sodium salt), are polycarboxylate builders of particular importance due to their availability from renewable resources and their biodegradability. Citrates can also be used in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g. $C_{12}$–$C_{18}$ monocarboxylic acids, can also be incorporated into the compositions alone, or in combination with the aforesaid builders, especially citrate and/or the succinate builders, to provide additional builder activity.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

3—The Anionic Surfactant

As a third essential element, the compositions herein comprise an anionic surfactant or mixtures thereof, in amounts of from 0.5% to 20% by weight of the total composition, preferably 3% to 15%, most preferably 5% to 10%.

Suitable anionic surfactant for use herein include water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethylammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water soluble salts or acids of the formula $RO(A)_mSO_3M$ wherein R is an unsubstituted C10–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Highly preferred surfactants for use in the compositions herein are the alkyl benzene sulfonates, especially the linear ones.

4—The Protease

As a fourth essential element, the compositions herein comprise a protease or mixtures thereof. Protease enzymes are usually present in preferred embodiments of the invention at levels sufficient to provide from 0.005 to 0.2 Anson units (AU) of activity per gram of composition. The proteolytic enzyme can be of animal, vegetable or, preferably microorganism preferred origin. More preferred is serine proteolytic enzyme of bacterial origin. Purified or nonpurified forms of enzyme may be used. Proteolytic enzymes produced by chemically or genetically modified mutants are included by definition, as are close structural enzyme variants. Particularly preferred by way of proteolytic enzyme is bacterial serine proteolytic enzyme obtained from Bacillus, *Bacillus subtilis* and/or *Bacillus licheniformis*. Suitable commercial proteolytic enzymes include Alcalase®, Esperase®, Durazym®, Savinase®, Maxatase®, Maxacal®, and Maxapem® 15 (protein engineered Maxacal); Purafect® and subtilisin BPN and BPN' are also commercially available. Preferred proteolytic enzymes also encompass modified bacterial serine proteases, such as those described in European Patent Application Serial Number 87303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme, which is called "Protease A" herein. More preferred is what is called herein "Protease C", which is a triple variant of an alkaline serine protease from Bacillus in which tyrosine replaced valine at position 104, serine replaced asparagine at position 123, and alanine replaced threonine at position 274. Protease C is described in EP 90915958.4, corresponding to WO 91/06637, Published May 16, 1991, which is incorporated herein by reference. Genetically modified variants, particularly of Protease C, are also included herein.

Also suitable for use herein is a protease herein referred to as "Protease D" which is a carbonyl hydrolase variant having an amino acid sequence not found in nature, which is derived from a percursor carbonyl hydrolase by substituting a different amino acid for a plurality of amino acid residues at a position in said carbonyl hydrolase equivalent to position +76 in combination with one or more amino acid residue positions equivalent to those selected from the gorup consisting of +99, +101, +103, +107 and +123 in *Bacillus amyloliquefaciens* subtilisin as described in the concurrently filed patent applications of A. Baeck, C. K. Ghosh, P. P. Greycar, R. R. Bott and L. J. Wilson, entitled "Protease-Containing Cleaning Compositions" having U.S. Ser. No. 08/136,797 (P&G Case 5040), and "Bleaching Compositions Comprising themselves be natural or be the product of genetic engineering. Stability can be measured using any of the art-disclosed technical tests. See references disclosed in WO 94/02597, itself and documents therein referred to being incorpated by reference.

In general, stability-enhanced amylases respecting the invention can be obtained from Novo Nordisk A/S, or from Genencor International.

Preferred amylases herein have the commonality of being derived using site-directed mutagenesis from one or more of the Bacillus amylases, especially the Bacillus alpha-amylases, regardless of whether one, two or multiple amylase strains are the immediate precursors.

As noted, "oxidative stability-enhanced" amylases are preferred for use herein. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *Bacillus licheniformis* alpha-amylase, known as TERMAMYL (R), or the homologous position variation of a similar parent amylase, such as *Bacillus amyloliquefaciens, Bacillus subtilis*, or *Bacillus stearothermophilus;*

(b) Stability-enhanced amylases as described by Genencor International in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *Bacillus licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in Protease Enzymes" having U.S. Ser. No. 08/136,626, which are incorporated herein by reference.

Some preferred proteolytic enzymes are selected from the group consisting of Savinase®, Esperase®, Maxacal®, Purafect®, BPN', Protease A and Protease B, and mixtures thereof. Bacterial serine protease enzymes obtained from *Bacillus subtilis* and/or *Bacillus licheniformis* are preferred. Particularly preferred are Savinase®, Alcalase®, Protease A and Protease B.

5—The Amylase

As a fifth essential element, the compositions herein comprise an amylase. Engineering of enzymes for improved stability, e.g. oxidative stability is known. See, for example J. Biological Chem., vol. 260, No. 11, June 1985, pp 6518–6521.

"Reference amylase" hereinafter refers to an amylase outside the scope of the amylase component of this invention and against which stability of any amylase within the invention can be measured.

The present invention thus makes use of amylases having improved stability in detergents, especially improved oxidative stability. A convenient absolute stability reference-point against which amylases used in the instant invention represent a measurable improvement is the stability of TERMAMYL (R) in commercial use in 1993 and available from Novo Nordisk A/S. This TERMAMYL (R) amylase is a "reference amylase". Amylases within the spirit and scope of the present invention share the characteristic of being "stability-enhanced" amylases, characterized, at a minimum, by a measurable improvement in one or more of: oxidative stability, e.g. to hydrogen peroxide/tetraacetylethylenediamine in buffered solution at pH 9–10; thermal stability, e.g. at common wash temperatures such as about 60° C.; or alkaline stability, e.g. at a pH from about 8 to about 11, all measured versus the above-idenfied reference-amylase. Preferred amylases herein can demonstrate further improvement versus more challenging reference amylases, the latter reference amylases being illustrated by any of the precursor amylases of which the amylases within the invention are variants. Such precursor amylases may CASCADE (R) and SUNLIGHT (R); Such enzymes are commercially available from Genencor under the trade name Plurafact Oxam®.

(c) Particularly preferred herein are amylase variants having additional modification in the immediate parent available from Novo Nordisk A/S. These amylases do not yet have a tradename but are those referred to by the supplier as QL37+M197T. Such enzymes are commercially available under the trade name SP 703 from Novo.

Any other oxidative stability-enhanced amylase can be used, for example as derived by site-directed mutagenesis from known chimeric, hybrid or simple mutant parent forms of available amylases.

6—Optionals

The soaking composition of the present invention may further comprise a variety of other ingredients.

Optional but preferred ingredients for use herein are bleach activators. Examples of suitable compounds of this type are disclosed in British Patent GB 1 586 769 and GB 2 143 231. Preferred examples of such compounds are tetracetyl ethylene diamine, (TAED), sodium 3, 5, 5 trimethyl hexanoyloxybenzene sulphonate, diperoxy dodecanoic acid as described for instance in U.S. Pat. No. 4 818 425 and nonylamide of peroxyadipic acid as described for instance in U.S. Pat. No. 4 259 201 and n-nonanoyloxybenzenesulphonate (NOBS), and acetyl triethyl citrate (ATC) such as described in European patent application 91870207.7. Also particularly preferred are N-acyl caprolactam selected from the group consisting of substituted or unsubstituted benzoyl caprolactam, octanyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam. The soaking compositions herein may comprise mixtures of said bleach activators.

Preferred mixtures of bleach activators herein comprise n-nonanoyloxybenzenesulphonate (NOBS) together with a second bleach activator having a low tendency to generate diacyl peroxide, but which delivers mainly peracid. Said second bleach activators may include tetracetyl ethylene diamine (TAED), acetyl triethyl citrate (ATC), acetyl caprolactam, benzoyl caprolactam and the like, or mixtures thereof. Said mixtures of bleach activators are preferably used in the embodiment of the present invention where the soaking liquors are controlled to a pH below 9.5. Indeed, it has been found that mixtures of bleach activators comprising n-nonanoyloxybenzenesulphonate and said second bleach activators, allow to boost particulate soil cleaning performance while exhibiting at the same time good performance on diacyl peroxide sensitive soil (e.g. beta-carotene) and on peracid sensitive soil (e.g. body soils).

Accordingly, the soaking compositions herein may comprise from 0% to 15% by weight of the total composition of n-nonanoyloxybenzenesulphonate, preferably from 1% to 10% and more preferably from 3% to 7% and from 0% to 15% by weight of the total composition of said second bleach activator preferably from 1% to 10% and more preferably from 3% to 7%.

It may be desirable for them to further comprise chelating agents which help to control the level of free heavy metal ions in the soaking liquors, thus avoiding rapid decomposition of the oxygen released by said source of available oxygen. Suitable amino carboxylate chelating agents which may be used herein include diethylene triamino pentacetic acid, ethylenediamine tetraacetates (EDTA), N-hydroxyethylethylenediamine triacetates, nitrilotriacetates, ethylenediamine tetraproprionates, triethylenetetraamine hexaacetates, and ethanoldiglycines, alkali metal ammonium and substituted ammonium salts thereof or mixtures thereof. Further suitable chelating agents include ethylenediamine-N,N'- disuccinic acids (EDDS) or alkali metal, alkaline earth metal, ammonium, or substituted ammonium salts thereof. Particularly suitable EDDS compounds are the free acid form and the sodium or magnesium salt or complex thereof. Also others suitable chelating agents may be the organic phosphonates, including amino alkylene poly(alkylene phosphonate), alkali metal ethane 1-hydroxy diphosphonates, nitrilo trimethylene phosphonates, ethylene diamine tetra methylene phosphonates and diethylene triamine penta methylene phosphonates. The phosphonate compounds may be present either in their acid form or in the form of their metal alkali salt. Preferably the organic phosphonate compounds where present are in the form of their magnesium salt.

The soaking compositions in the present invention may accordingly comprise from 0% to 5% by weight of the total compositions of said chelating agents, preferably from 0% to 3%, more preferably from 0.05% to 2%.

Soaking compositions in the present invention may further comprise other optional ingredients such as additional surfactants, other than anionics, fillers, optical brighteners, additional enzymes, soil release agents, photoactivated bleaches such as Zn phthalocyanine sulphonate, dyes, dye transfer inhibitors, pigments and perfumes. Said optional ingredients can be added in varying amounts as desired.

The compositions herein can be manufactured in solid, preferably granular, or liquid form.

B—The Process

In a second embodiment, the present invention encompasses a process of soaking fabrics. As used herein, the expression "process of soaking fabrics" refers to the action of leaving fabrics to soak in a soaking liquor comprising water and a composition as described hereinabove, for a period of time sufficient to clean said fabrics. The soaking process can be performed independently from any other process, such as a typical laundering operation, or a first step before a second, typical laundering step. In the preferred soaking processes of the invention, fabrics are left to soak for a period of time ranging from 10 minutes to 24 hours, preferably from 30 min to 24 hours, most preferably 4 hours to 24 hours. After the fabrics have been immersed in said soaking liquor for a sufficient period of time, they can be removed and rinsed with water. The fabrics can also be washed in a normal laundering operation after they have been soaked, with or without having been rinsed inbetween the soaking operation and the subsequent laundering operation.

In the soaking process herein, a soaking composition described hereinabove is diluted in an appropriate amount of water to produce a soaking liquor. Suitable doses may range from 45 to 50 grams of soaking composition in 3.5 to 5 liters of water, down to 90 to 100 grams of soaking composition in 20 to 45 liters of water. Typically one dose is 45–50 grams in 3.5 to 5 Lt for a concentrated soak (bucket/sink). For washing machine soaks, the dose is 90–100 grams in about (Europe) to 45 (US) liter of water. The fabrics to be soaked are then immersed in the soaking liquor for an appropriate period of time.

There are factors which may influence overall performance of the process on particulate dirt/soils. Such factors include prolonged soaking time. Indeed, the longer fabrics are soaked, the better the end results. Ideally soaking time is ovemight, i.e. 12 hours up to 24 hours. Another factor is the initial warm or warmluke temperature. Indeed higher initial temperatures of the soaking liquors ensure large benefits in performance.

EXAMPLES

The following compositions are made by mixing the listed ingredients in the listed proportions. Soaking liquors are formed by diluting each time 45 g of said compositions in between 3.5 lit. to 5.0 lit. of water. 0.5 to 2 Kg of fabrics are then each time immersed in said soaking liquor for a time ranging from 10 minutes to 24 hours. Finally, the fabrics are removed from the soaking liquors, rinsed with water and washed with a regular washing process, handwash or washing machine wash, with a regular detergent, with or without re-using the soaking liquor, then said fabrics are left to dry.

| Ingredient | 1 (% w/w) | 2 (% w/w) | 3 (% w/w) |
|---|---|---|---|
| Plurafact Oxam ® or SP 703 (@4% active protein) | 0.29 | 0.29 | 0.29 |
| Protease B; @4% active protein) | 0.26 | 0.52 | 0.52 |
| Sodium perborate monohydrate | 29 | 29 | 29 |
| Sodium percarbonate | 0 | 0 | 0 |
| Citric acid | 11 | 11 | 11 |
| Zeolite A | 12 | 12 | 12 |
| Polyacrylate (Acusol 445ND) | 10 | 10 | 10 |
| Sodium silicate (amorphous; 1.6r) | 0.3 | 0.3 | 0.3 |
| Anionic (LAS) | 7 | 7 | 7 |
| NOBS | 10 | 10 | 5 |
| TAED | 0 | 0 | 5 |
| DTPA | 0.2 | 0.2 | 0.2 |
| Other, inerts and minors | up to 100 | up to 100 | up to 100 |

-continued

| Ingredient | 4 (% w/w) | 5 (% w/w) | 6 (% w/w) |
|---|---|---|---|
| Plurafact Oxam ® or SP 703 (@4% active protein) | 0.26 | 0.26 | 0.26 |
| Protease (B; @4% active protein) | 1.00 | 0.50 | 0.50 |
| Sodium perborate monohydrate | 0 | 0 | 0 |
| Sodium percarbonate | 31 | 31 | 31 |
| Citric acid | 10 | 10 | 10 |
| Zeolite A | 0 | 0 | 0 |
| Polyacrylate (Acusol 445ND) | 11 | 11 | 11 |
| Sodium silicate (amorphous; 1.6r) | 0.4 | 0.4 | 0.4 |
| Anionic (LAS) | 4 | 4 | 4 |
| NOBS | 6 | 6 | 0 |
| TAED | 6 | 6 | 12 |
| DTPA | 0.2 | 0.2 | 0.2 |
| Other, inerts and minors | up to 100 | up to 100 | up to 100 |

We claim:

1. A fabric pretreating composition comprising:

a. an oxygen bleach system, wherein said oxygen bleach system consists of a hydrogen peroxide source and a bleach activator wherein said bleach activator is the only bleach activator in the oxygen bleach system and is selected from the group consisting of n-nonanoyloxybenzenesulfonate (NOBS), tetracetyl ethylene diamine (TAED), acetyl triethyl citrate (ATC), sodium 3,5,5 trimethyl hexanoyloxybenzene sulfonate, substituted or unsubstituted benzoyl caprolactam, octanoyl caprolactam, nonanoyl caprolactam, hexanoyl caprolactamn, decanoyl caprolactam, undecanoyl caprolactam, formyl caprolactam, acetyl caprolactam, propanoyl caprolactam, butanoyl caprolactam, pentanoyl caprolactam and mixtures thereof;

b. from 5% to 50% by weight of the total composition of a builder;

c. from 0.5% to 20% by weight of the total composition of an anionic surfactant;

d. a proteolytic enzyme; and e. a oxidative stability enhanced amylase enzyme, wherein said oxidative stability amylase enzyme is enhanced from substitution using threonine of the methionine residue located in position 197 of the *Bacillus licheniformis* or the homologous position variation of a similar parent amylase;

wherein said oxygen bleach, builder, anionic surfactant, proteolytic enzyme and stability enhanced amylase enzyme are present in said fabric pretreating composition at levels such that said stability enhanced amylase enzyme is active in a fabric pretreating liquor including said soaking composition 30 minutes to 24 hours after said fabric pretreating composition is added to the soaking liquor in the absence of mechanical agitation.

2. A composition according to claim 1 wherein said anionic surfactant is a linear alkyl benzene sulphonate.

3. A composition according to claim 1 which comprises 3% to 15% of said anionic surfactant.

4. A composition according to claim 3 which comprises 5% to 10% of said anionic surfactant.

5. A composition according to claim 1 which comprises from 10% to 40% of said builder.

6. A composition according to claim 5 which comprises from 15% to 30% of said builder.

7. A composition according to claim 1 which comprises from 1% to 60% of said hydrogen peroxide source.

8. A composition according to claim 7 which comprises from 15% to 40% of said hydrogen peroxide source.

9. A composition according to claim 1 wherein said hydrogen peroxide source is an alkali metal salt of perborate or percarbonate.

10. A composition according to claim 1 wherein said protease is selected from the group consisting of bacterial serine proteolytic enzymes obtained from *Bacillus subtilis*, bacterial serine proteolytic enzymes obtained from *Bacillus licheniformis* and mixtures thereof.

11. A process of soaking fabrics in need of cleaning, wherein said fabrics in need of cleaning are immersed in a soaking liquor comprising an effective amount of a composition according to claim 10, for an effective period of time such that said composition cleans said fabrics in need of cleaning.

12. A process according to claim 11 wherein said time ranges from about 10 minutes to about 24 hours.

13. A process of soaking fabrics in need of cleaning according to claim 11, wherein said effective amount of said composition ranges from 2 g/L to 14.3 g/L.

* * * * *

UNITED STATES PATENT AND TRADEMARK OFFICE

CERTIFICATE OF CORRECTION

PATENT NO. : 5,922,083

DATED : July 13, 1999

INVENTOR(S) : Lamberto Biscarini and Marina Trani

It is certified that error appears in the above-identified patent and that said Letters Patent is hereby corrected as shown below:

Column 12, line 31, "caprolactamn" should read –caprolactam--.

Column 12, line 51, "soaking composition" should read –soaking fabric pretreating composition--.

Column 12, line 53, "soaking liquor" should read –soaking fabric pretreating--.

Signed and Sealed this

Seventh Day of December, 1999

*Attest:*

Q. TODD DICKINSON

*Attesting Officer*

*Acting Commissioner of Patents and Trademarks*